United States Patent [19]

Nosek

[11] 4,428,512

[45] Jan. 31, 1984

[54] SPRAY NOZZLE ACTUATOR

[76] Inventor: Frank J. Nosek, 28 W. 715 Mount St., Warrenville, Ill. 60555

[21] Appl. No.: 398,675

[22] Filed: Jul. 15, 1982

[51] Int. Cl.[3] ..... B65D 83/06

[52] U.S. Cl. ..... 222/402.15; 222/402.21; 251/291; 251/298

[58] Field of Search ..... 222/174, 180, 394, 402.1, 222/402.13, 402.15, 402.21, 402.22, 402.23, 505, 509, 567, 570; 251/251, 291, 298

[56] References Cited

U.S. PATENT DOCUMENTS

| | | | |
|---|---|---|---|
| 2,941,700 | 6/1960 | Gable | 222/394 |
| 2,960,260 | 11/1960 | Kutik | 222/473 |
| 3,045,878 | 7/1962 | Blanford et al. | 222/473 |
| 3,089,625 | 5/1963 | Sorber et al. | 222/398 |
| 3,318,493 | 5/1967 | Belpedio | 222/402.15 |
| 4,068,782 | 1/1978 | Van der Heijden | 222/402.13 |
| 4,111,338 | 9/1978 | Cheng et al. | 222/180 |
| 4,223,812 | 9/1980 | van Lit | 222/180 |

*Primary Examiner*—Joseph J. Rolla
*Assistant Examiner*—Michael S. Huppert
*Attorney, Agent, or Firm*—Wood, Dalton, Phillips, Mason & Rowe

[57] ABSTRACT

An actuator for use with an aerosol container including a depressor bar having opposite hooks at the ends thereof embracing oppositely projecting annular walls of the container. The upper hook includes a retainer at the distal end of a spring finger portion thereof configured to retain the depressor bar in spaced relationship to the container while permitting inward urging of the depressor bar to urge the distal end of the retainer against the spray nozzle for actuation thereof.

16 Claims, 4 Drawing Figures

SPRAY NOZZLE ACTUATOR

BACKGROUND OF THE INVENTION

1. Field of the Invention

This invention relates to actuators for use with an aerosol container having a tilt-actuatable valved spray nozzle.

2. Description of the Prior Art

In U.S. Pat. No. 3,045,878, William F. Blanford et al. disclose an operating handle for an aerosol container into which the spray can may be fitted and secured without use of closing means. The handle carries a trigger assembly which is pivotally mounted thereto and which includes an outer tip overlying the control button of the spray can to engage it for displacement in response to movement of the operating lever.

In U.S. Pat. No. 4,223,812, Klass J. van Lit discloses a wall mounted receptacle for aerosol cans including a wall mountable bracket which receives and supports the container in a fixed position, and a shroud member enclosing the container and the bracket which defines an opening receiving the valve stem of the spray can. The shroud members pivotally attach to the bracket at a point spaced from the valve such that the valve stem is tilted by the shroud member when the shroud member is pivoted on the bracket.

SUMMARY OF THE INVENTION

The present invention comprehends an improved actuator with use with an aerosol container having a first end defining a first annular end, an opposite, second end having a tilt-actuatable valved spray nozzle and a second annular wall concentrically about the nozzle. The actuator includes a rigid depressor bar, a first hook at one end of the bar engaging a lower end of the container, and a second hook at the opposite end of the bar engaging the upper end of the container. The second hook includes a spring finger having a retainer on the distal end thereof which is captured between the container spray nozzle and the second annular wall for actuating the spray nozzle as a result of movement of the depressor bar pivotally about the first annular wall engaged by the first hook.

The first hook defines a distal portion extending angularly inwardly to be received in a downwardly opening recess of the container defining the lower first annular wall.

The spacing between the hooks, and more specifically between the retainer and the first hook, is less than the spacing between the container annular walls so that the spring finger resiliently maintains the container captured between the actuator hooks, and more specifically, between the retainer and the first hook.

The actuator of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
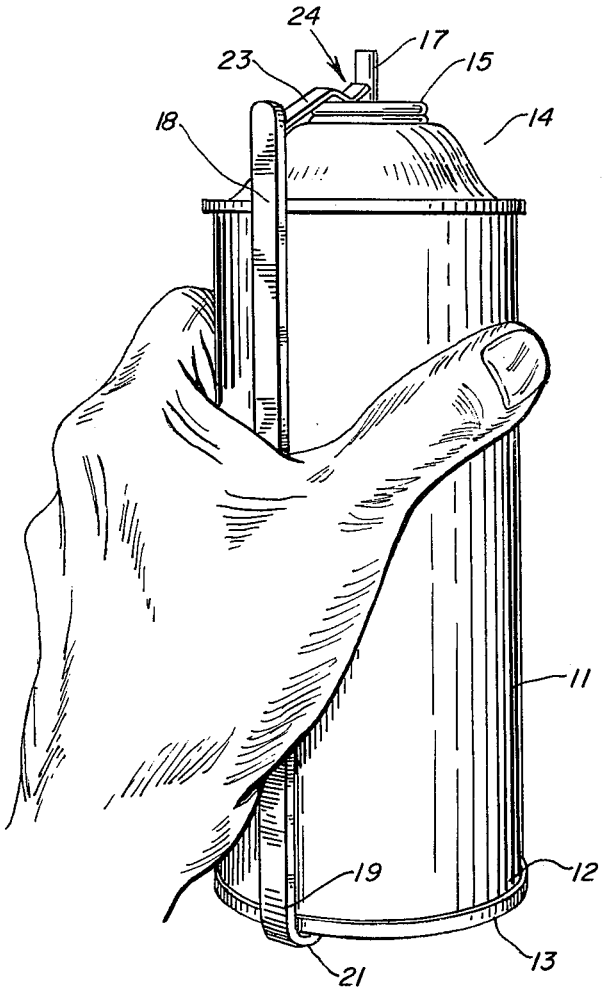
FIG. 1 is a perspective view illustrating a method of grasping the aerosol container for actuation of the spray nozzle by manipulation of the actuator.

In the illustrative embodiment of the invention as disclosed in the drawing, an actuator 10 is shown for use with an aerosol container 11 having a first end 12 defining a first annular wall 13, and an opposite, second end 14 defining a second opposite annular wall 15.

Figure 3:
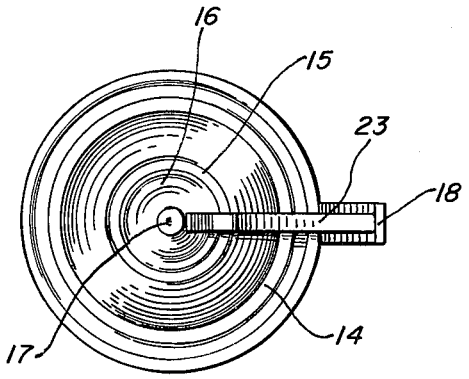
FIG. 3 is a top plan view of the assembly of FIG. 2.
Figure 4:
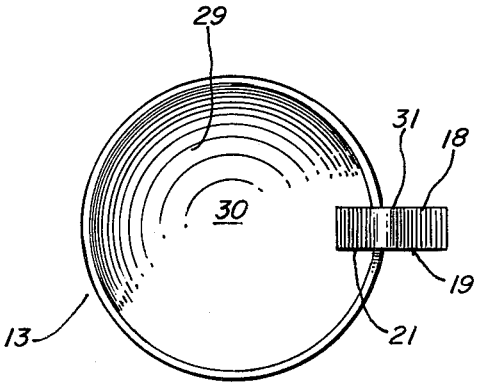
FIG. 4 is a bottom plan view thereof.

Annular wall 15 defines the periphery of a cup member 16 provided with a tilt-actuated valved spray nozzle 17. As shown in FIG. 3, annular wall 15 extends concentrically about the nozzle 17. The spray nozzle comprises a conventional tilt-actuated valved spray nozzle of the type well-known in the art and requires no further description herein.

Actuator 10 includes a rigid depressor bar 18 having a first end 19 and an opposite, second end 20. Bar end 19 defines a turned distal portion 21 forming a hook which is pivotally engaged with the annular wall 13, as best seen in FIG. 2.

The actuator further defines a second hook, generally designated 22, at end 20 of the actuator bar. Hook 22 includes a spring finger 23 projecting from bar end 20 and having a distal retainer, generally designated 24, configured to be captured between the container spray nozzle 17 and the second annular wall 15, as illustrated in FIG. 2.

In the illustrated embodiment, the spring finger is fixedly secured to actuator bar end 20 by a connecting portion 25 as by welding 26. The spring finger has a length preselected to cause the depressor bar 18 to extend from annular wall 13 away from the container 11 to provide a clearance space 27 between the actuator bar and the container such that urging of the depressor bar pivotally about the annular wall 13 toward the container so as to reduce the clearance space 27 urges the retainer 24 laterally against the valve spray nozzle to cause tilted actuation thereof.

Figure 2:
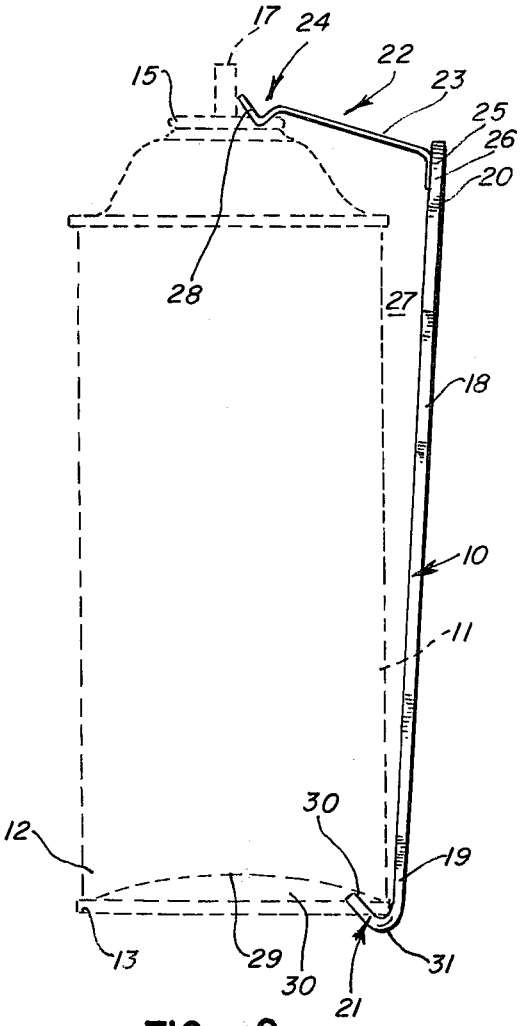
FIG. 2 is a side elevation, with the aerosol container shown in broken lines, illustrating the mounting of the actuator to the aerosol container.

As best seen in FIG. 2, the spring finger 23 extends at an obtuse angle of slightly greater than 90° to the longitudinal extent of the depressor bar 18, thereby providing additional resiliency between the two hooks 21 and 22.

In the illustrated embodiment, retainer 24 is formed integrally with the spring finger and, more specifically, comprises a V-shaped integral distal end of the spring finger.

As shown in FIG. 2, the width of the "V" configuration of retainer 24 is greater than the spacing of the container second annular wall from the spray nozzle.

Retainer 24 defines a distal angled portion 28 forming a cam surface configured to engage the annular wall 15 as the spring finger 23 is moved toward the spray nozzle 17 so as to cam the retainer over the annular wall 25 against the resiliency of the spring finger when the spring finger is urged radially toward the spray nozzle to the installed position of FIG. 2.

As illustrated in FIG. 2, container end 12 is defined by a concave, arcuate dome-shaped end wall 29. Hook end portion 21 extends into the space 30 defined by the wall 29. In the illustrated embodiment, the hook portion 21 extends at an angle of approximately 45° to the longitudinal extent of the depressor bar 18 so as to permit the hook end to be received in space 30 in embracing relationship to the lower annular wall 13 of the container 11. In the installed disposition, the tip 30 of hook end 21 is juxtaposed to the wall 29, as illustrated in FIG. 2.

As shown, hook end 21 extends rectilinearly from a rounded connection 31 to the depressor bar end 19.

In the illustrated embodiment, the spacing between hooks 21 and 22 is less than the spacing between the container annular walls 13 and 15 so that the spring finger resiliently retains the container captured between the hooks. More specifically, as shown, the spacing between the retainer 24 and the hook 21 is less than the spacing between the wall 15 and wall 13 to provide the desired maintained captured association of the container with the actuator. As shown, retainer 24 effectively projects toward hook 21 from the inner end of the spring finger 23.

As shown in FIGS. 1 and 2, the spring finger 23 has a thickness less than that of the rigid depressor bar 18 and as shown in FIG. 3, the spring finger has a width less than the width of the depressor bar.

In the illustrated embodiment, the valved spray nozzle 17 is arranged to discharge spray from the container only when the container is disposed with the nozzle lowermost, i.e. in a downward disposition. The actuator 10 is installed on the container, as illustrated in FIGS. 1 and 2, by firstly hooking the lower hook 21 under the lower annular wall 13 and urging the retainer 24 into the space between spray nozzle 17 and top annular wall 15 by a pivotal movement of the depressor bar 18 in a counterclockwise direction, as seen in FIG. 2, about the annular wall 13. As indicated above, retainer end portion 28 acts as a cam means in deflecting the spring finger 23 upwardly to permit the retainer to ride over annular wall 15 into the space in cup member 16 between the spray nozzle and annular wall 15.

To effect a spraying operation, the user merely inverts the container 11 so as to dispose the spray nozzle 17 lowermost. Urging of the depressor bar 18 inwardly toward container 11 by the urging of the user's hand thereagainst while grasping the container 11 between the thumb and fingers, causes the retainer portion 28 to bear against the spray nozzle 17 suitably deflecting it laterally for effecting tilt actuation of the valved spray nozzle to effect a spraying of the contents of the container downwardly therethrough.

This mode of operation of the device effectively prevents fatigue of the user's hands and permits the user to hold the can in spraying position for extended periods of time without tiring. Thus, an improved spraying operation is obtained by means of the actuator 10.

Actuator 10 is extremely simple and economical of construction and may be readily formed of any suitable material, such as metal, synthetic resin, etc. In the illustrated embodiment, the top hook portion 11 including the spring finger and retainer, comprise a separate element secured to the upper end 20 of depressor bar 18. As will be obvious to those skilled in the art, the hook may be formed integrally with the bar within the scope of the invention.

The actuator is readily installed and removed from the container so that it may be stored separately from the container when not in use.

As no moving parts are required in the actuator, the actuator has long, troublefree life, while yet being capable of manufacture at extemely low cost.

The foregoing disclosure of specific embodiments is illustrative of the broad inventive concepts comprehended by the invention.

I claim:

1. An actuator for use with an aerosol container having a first end defining a first annular wall, an opposite second end having a tilt-actuatable valved spray nozzle and a second annular wall concentrically about said nozzle, said actuator comprising:

a depressor bar;

a first hook at one end of the bar configured to hook about the container first annular wall; and a second hook at the opposite end of the bar including a spring finger projecting from the bar and having a distal retainer configured to be captured between the container spray nozzle and the second annular wall, and a connecting portion connected to said other end of the bar, said spring finger having a length preselected to cause the depressor bar to extend from the first annular wall away from the container to provide a clearance space therebetween such that urging of the depressor bar pivotally about said first annular wall toward the container to reduce said clearance space urges the retainer laterally against the valved spring nozzle to cause tilted actuation thereof.

2. The spring nozzle actuator of claim 1 wherein said spring finger extends at an obtuse angle to the longitudinal extent of said depressor bar.

3. The spray nozzle actuator of claim 1 wherein said retainer is formed integrally with said spring finger.

4. The spray nozzle actuator of claim 1 wherein said retainer comprises a V-shaped integral distal end of the spring finger.

5. The spray nozzle actuator of claim 1 wherein said retainer comprises a V-shaped integral distal end of the spring finger, the width of the V configuration being greater than the spacing of the second annular wall from the spray nozzle.

6. The spray nozzle actuator of claim 1 wherein said depressor bar is substantially rectilinear.

7. The spray nozzle actuator of claim 1 wherein said retainer defines a distal cam surface configured to engage the container second annular wall and cam the spring finger over the second annular wall as an incident of the spring finger being urged radially inwardly toward the spray nozzle.

8. An actuator for use with an aerosol container having a first end defining a recess having a peripheral first annular wall, an opposite second end having a tilt-actuatable valve spray nozzle, and a second annular wall concentrically about said nozzle, said actuator comprising:

a depressor bar;

a first hook at one end of the bar configured to hook about the container first annular wall and defining a distal portion extending angularly inwardly to be received in the container recess;

and a second hook at the opposite end of the bar including a spring finger at the other end of the bar having a distal retainer configured to be captured between the container spray nozzle and the second annular wall, and a connecting portion connected to said other end of the bar, said spring finger having a length preselected to cause the depressor bar to extend from the first annular wall away from the container to provide a clearance space therebetween such that urging of the depressor bar toward the container to reduce said clearance space urges the retainer laterally against the valved spray nozzle to cause tilted actuation thereof.

9. The spray nozzle actuator of claim 8 wherein said recess is arcuate.

10. The spray nozzle actuator of claim 8 wherein said recess is dome-shaped.

11. The spray nozzle actuator of claim 8 wherein said distal portion of the hook seats against the container first end in the recess inwardly of the container first annular wall.

12. The spray nozzle actuator of claim 8 wherein said distal end extend rectilinearly angularly inwardly from said one end of the depressor bar.

13. An actuator for use with an aerosol container having a first end defining a first annular wall, an opposite second end having a tilt-actuatable valved spray nozzle, and a second annular wall concentrically about said nozzle, said actuator comprising:

a depressor bar;

a first hook at one end of the bar configured to hook about the container first annular wall; and a second hook at the opposite end of the bar including a spring finger at the other end of the bar having a distal retainer configured to be captured between the container spray nozzle and the second annular wall, and a connecting portion connected to said other end of the bar, said spring finger having a length preselected to cause the depressor bar to extend from the first annular wall away from the container to provide a clearance space therebetween such that urging of the depressor bar toward the container to reduce said clearance space urges the retainer laterally against the valved spray nozzle to cause tilted actuation thereof, the spacing between said retainer and said first hook being less than the spacing between the container annular walls whereby said spring finger resiliently maintains the container captured between the retainer and the first hook.

14. The spray nozzle actuator of claim 13 wherein said retainer comprises an integral distal end of the spring finger projecting toward said first hook.

15. The spray nozzle actuator of claim 13 wherein said spring finger comprises a bar element having a thickness less than that of said depressor bar.

16. The spray nozzle actuator of claim 13 wherein said spring finger comprises a bar element having a thickness less than that of said depressor bar and extending at an obtuse angle to the longitudinal extent of the depressor bar.

* * * * *